United States Patent [19]

Joyce

[11] Patent Number: 4,973,096

[45] Date of Patent: Nov. 27, 1990

[54] SHOE TRANSPORTING DEVICE

[76] Inventor: Patrick H. Joyce, 2510 Dempster St., Des Plaines, Ill. 60016

[21] Appl. No.: 396,274

[22] Filed: Aug. 21, 1989

[51] Int. Cl.[5] ..... A45F 5/10; A47F 7/08

[52] U.S. Cl. ..... 294/162; 294/165; 294/169

[58] Field of Search ..... 294/137, 141-143, 294/146, 148, 151, 159, 162-169; 12/120.5; 211/34, 37, 38

[56] References Cited

U.S. PATENT DOCUMENTS

| | | | |
|---|---|---|---|
| 2,346,344 | 4/1944 | Anderson | 12/120.5 |
| 2,680,258 | 6/1954 | Salzman | 12/120.5 |
| 3,013,286 | 12/1961 | Barreca | 294/162 X |
| 3,145,402 | 8/1964 | Kaminski | 294/162 X |
| 3,237,225 | 3/1966 | Schleman | 294/162 X |
| 3,237,226 | 3/1966 | Gjesdahl | 294/162 X |
| 3,619,837 | 11/1971 | Smolka | 294/162 X |
| 4,320,916 | 3/1982 | Crump | 294/163 X |
| 4,326,746 | 4/1982 | Grihalva | 294/162 X |

FOREIGN PATENT DOCUMENTS

| | | | |
|---|---|---|---|
| 952331 | 11/1949 | France | 12/120.5 |
| 2403769 | 5/1979 | France | 294/162 |
| 911 | of 1903 | United Kingdom | 12/120.5 |

*Primary Examiner*—Johnny D. Cherry

*Attorney, Agent, or Firm*—Wood, Phillips, Mason, Recktenwald & Vansanten

[57] ABSTRACT

A device for transporting a pair of shoes is disclosed which can be utilized to display the shoes as well. The shoe transporting device includes a base adapted to receive the heels of the pair of shoes and to support the pair of shoes in a generally vertical orientation. It also includes a vertical divider extending upwardly of the base and terminating in a shoe carrying handle at a point remote from the base. The shoe transporting device further includes a releasable retainer associated with the vertical divider for retaining shoes in the generally vertical orientation. In a preferred embodiment, the releasable retainer comprises a pair of resilient clips disposed on the vertical divider intermediate the base and the shoe carrying handle.

9 Claims, 1 Drawing Sheet

SHOE TRANSPORTING DEVICE

FIELD OF THE INVENTION

The present invention generally relates to a shoe transporting device and, more particularly, a device for transporting a pair of shoes in an effective manner.

BACKGROUND OF THE INVENTION

Generally speaking, new shoes of nearly every type are shipped from the manufacturer in a cardboard box. They typically remain in this box while in inventory at the retailer, and the box is then used by the purchaser of the shoes to transport them from the shoe store to his or her home. However, this method of transporting a pair of shoes is less than entirely desirable.

While a cardboard box may be satisfactory for shipment from the manufacturer to the retailer, the same cannot be said once the consumer has purchased a pair of shoes. The box is characteristically unwieldy to carry alone, particularly where the lid of the box has not been fully secured by string and/or tape. Recognizing this problem, retailers have resorted to providing a plastic bag to render it easier to transport the cardboard box with the shoes therein.

While this at least addresses one problem, it introduces yet other problems due to the use of double packaging. More specifically, this method of transporting shoes results in added packaging expenses, and it also results in a greater quantity of waste products for disposal once the packaging has served its very limited useful purpose. Still further, this form of packaging does nothing towards providing a method for displaying the shoes in a store or after purchase.

In this connection, it is now well known that athletic shoes, in particular, constitute an important market segment. This very competitive market sees the major manufacturers constantly creating new models and always seeking new means for gaining exposure of their styles and trademarks to the consuming public. With conventional packaging, the shoes are clearly not visible when the consumer is transporting them immediately after purchase.

For this reason, it would be desirable to have a device for effectively transporting a pair of shoes in an openly visible manner. It would likewise be desirable to have a shoe transporting device which could also function as a display of a manufacturer's shoes within a retail establishment. Additionally, it would be desirable to have a device for transporting a pair of shoes that would be reusable as desired by the consumer.

The present invention is directed to overcoming the foregoing problems and achieving the resulting objectives.

SUMMARY OF THE INVENTION

As a result, the present invention is directed to a unique new device for transporting a pair of shoes in an effective manner. The shoe transporting device includes a base adapted to receive the heels of the pair of shoes and to support the pair of shoes in a generally vertical orientation. It also includes a vertical divider extending upwardly of the base and terminating in a shoe carrying handle at a point remote from the base. The shoe transporting device further includes means associated with the vertical divider for releasably retaining the pair of shoes in the generally vertical orientation. With this arrangement, the shoe transporting device can be utilized not only for transporting a pair of shoes but additionally as a shoe display device.

In an exemplary embodiment, the shoe retaining means includes a pair of resilient clips disposed on the vertical divider intermediate the base and the shoe carrying handle. The clips are preferably disposed on the vertical divider in a position to grip the toes of the pair of shoes. It is also advantageous for the vertical divider to include a first portion integral with the base and a second portion pivotally mounted to the first portion remote from the base. The pair of resilient clips are then preferably disposed on the second portion of the vertical divider to grip the toes of the pair of shoes. It is further advantageous to have means associated with the base for releasably receiving the heels of the pair of shoes in oppositely facing direction on opposite sides of the vertical divider. The heel receiving means preferably includes a flange conforming to the heels of the pair of shoes and extending substantially entirely about the periphery of the base. With these features, the shoe transporting device is well suited for its intended purposes of not only transporting a pair of shoes but also displaying them as well.

In a highly preferred embodiment, the shoe transporting device includes means associated with the vertical divider for adjusting the location where the second portion is pivotally mounted to the first portion to adjust the height of the vertical divider to accommodate different sized shoes. In particular, the pivotal mounting adjustment means advantageously includes multiple alignable openings arranged such that the second portion of the vertical divider has an opening adapted for alignment with and securement by means of a releasable fastener to any of a plurality of vertically spaced openings in the first portion of the vertical divider.

Other features of the present invention include the base being generally oval-shaped and the vertical divider being generally planar to divide the base into opposed heel-receiving portions on opposite sides thereof. The soles of the pair of shoes are then advantageously in generally confronting relation in engagement with the vertical divider on opposite sides thereof. With this arrangement, the vertical divider is preferably such that the second portion is pivotable into and out of coaxial relation with the first portion for retaining and releasing shoes therefrom. The toes of the shoes are gripped by the resilient clips which are advantageously disposed on the second portion of the vertical divider when the first and second portions are coaxial. Additionally, a stop is associated with the vertical divider for restricting pivotal movement in one direction when the first and second portions are coaxial.

With regard to the stop, it is preferably associated with the vertical divider for allowing pivotal movement of the second portion of the vertical divider in one direction to move the first and second portions out of coaxial relation to release the pair of shoes. Conversely, the stop is associated with the vertical divider for restricting pivotal movement of the second portion of the vertical divider in the opposite direction once the first and second portions have been moved into coaxial relation to retain the pair of shoes.

With the foregoing features of construction, the second portion of the vertical divider preferably has an extension for supporting the resilient clips intermediate opposite ends thereof. It is also advantageous for the shoe carrying handle to be disposed on the end of the second portion of the vertical divider remote from the base and a stationary shoe-retaining plate may be provided on an extension of the first portion of the vertical divider remote from the base. In particular, the stationary shoe-retaining plate is advantageously positioned for engagement by the soles of the pair of shoes when the toes are gripped by the resilient clips.

Still other objects, advantages and features of the present invention will become apparent from a consideration of the following specification taken in conjunction with the accompanying drawings.

DETAILED DESCRIPTION OF THE PREFERRED EMBODIMENT

Figure 1:
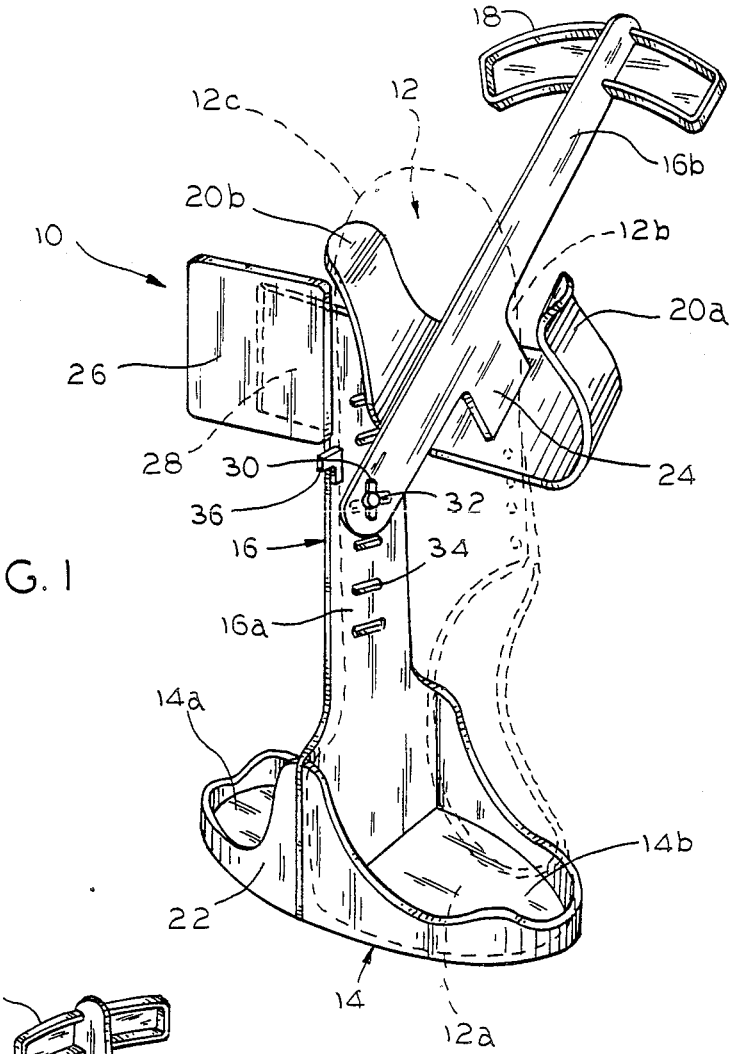
FIG. 1 is a perspective view of a shoe transporting device in a first position.
Figure 2:
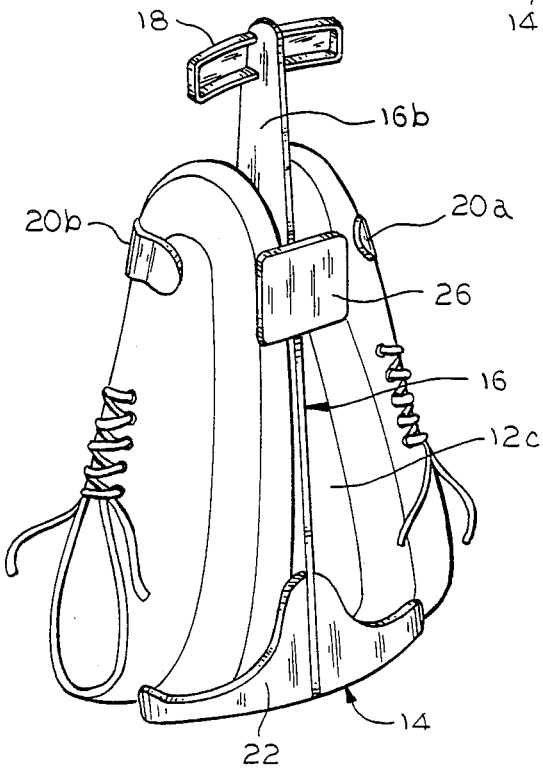
FIG. 2 is a perspective view of the shoe transporting device in a second position.

Referring to FIGS. 1 and 2, the reference numeral 10 designates generally a device for transporting a pair of shoes 12 in accordance with the present invention. The shoe transporting device 10 includes a base generally designated 14 which is adapted to receive the heels 12*a* of the pair of shoes 12 so as to support the pair of shoes 12 in a generally vertical orientation. It also includes a vertical divider generally designated 16 which extends upwardly of the base 14 and terminates in a shoe carrying handle 18 at a point remote from the base 14. The shoe transporting device 10 further includes means associated with the vertical divider 16 for releasable retaining the pair of shoes 12 in the generally vertical orientation. In particular, the shoe retaining means includes a pair of resilient clips 20*a* and 20*b* disposed on the vertical divider 16 intermediate the base 14 and the shoe carrying handle 18.

As shown in FIG. 2, the resilient clips 20*a* and 20*b* are disposed on the vertical divider 16 in a position to grip the toes 12*b* of the pair of shoes 12. More specifically, the vertical divider 16 includes a first portion 16*a* integral with the base 14 and a second portion 16*b* pivotally mounted to the first portion 16*a* remote from the base 14. With this understanding, it will be seen that the pair of resilient clips 20*a* and 20*b* are advantageously disposed on the second portion 16*b* of the vertical divider 16 to accomplish the intended gripping function.

As shown in both of FIGS. 1 and 2, the shoe transporting device 10 also includes means associated with the base 14 for releasably receiving the heels 12*a* of the pair of shoes 12 in oppositely facing direction on opposite sides of the vertical divider 16. In this connection, the base 14 is preferably generally oval-shaped and the vertical divider 16, i.e., the first portion 16*a* thereof, is generally planar to divide the base 14 into opposed heel-receiving portions 14*a* and 14*b* on opposite sides thereof. With this construction, the heel receiving means preferably includes a flange 22 which conforms to the heels 12*a* of the pair of shoes 12 and extends substantially entirely about the periphery of the base 14 in the manner illustrated.

In the preferred embodiment, both the first portion 16*a* and the second portion 16*b* of the vertical divider 16 are generally co-planar. The vertical divider 16 is also constructed such that the second portion 16*b* is pivotable into and out of coaxial relation with the first portion 16*a* for retaining and releasing shoes 12 therefrom (compare FIGS. 1 and 2). As will be appreciated, the resilient clips 20*a* and 20*b* are disposed on the second portion 16*b* of the vertical divider 16 to grip the toes 12*b* of the shoes 12 when the first and second portion 16*a* and 16*b* are coaxial.

In addition to the foregoing, the second portion 16*b* of the vertical divider 16 has an extension 24 for supporting the resilient clips 20*a* and 20*b* intermediate opposite ends of the second portion 16*b*. The shoe carrying handle 18 is then disposed on the end of the second portion 16*b* of the vertical divider 16 remote from the base 14, and the first portion 16*a* of the vertical divider 16 includes a stationary shoe-retaining plate 26 on an extension 28 remote from the base 14. As shown, the stationary shoe-retaining plate 26 is positioned for engagement by an edge of the soles 12*c* of the pair of shoes 12 when the toes 12*b* are gripped by the resilient clips 20*a* and 20*b*.

As shown in FIG. 1, the shoe transporting device 10 includes means associated with the vertical divider 16 for adjusting the location where the second portion 16*b* is pivotally mounted to the first portion 16*a* to adjust the height of the vertical divider 16 to thereby accommodate different sized shoes 12. In particular, the pivotal mounting adjustment means includes an opening 30 in the second portion 16*b* of the vertical divider 16 adapted for alignment with and securement by means of a releasable fastener 32 to any of a plurality of vertically spaced openings 34 in the first portion 16*a* of the vertical divider 16.

By utilizing this adjustment feature, the distance between the base 14 and the clips 20*a* and 20*b* can be varied to position the clips 20*a* and 20*b* so as to grip the toes 12*b* of various sized shoes 12 in the generally vertical orientation thereof.

In the preferred embodiment, the shoe transporting device 10 includes a stop 36 associated with the vertical divider 16. The stop 36 allows pivotal movement of the second portion 16*b* of the vertical divider 16 in one direction relative to the first portion 16*a* to move the first and second portions 16*a* and 16*b* out of coaxial relation to release the pair of shoes 12. The stop 36 also restricts pivotal movement of the second portion 16*b* of the vertical divider 16 relative to the first portion 16*a* in the opposite direction when the first and second portions 16*a* and 16*b* have been moved into coaxial relation to retain the pair of shoes 12. As shown, the stop 36 is integral with the first portion 16*a* of the vertical divider 16 in the illustrated embodiment.

As previously mentioned, the base 14 is generally oval-shaped to receive the heels 12*a* of the pair of shoes 12. The heels 12*a* are received with the soles 12*c* in generally confronting relation in engagement with the vertical divider 16 on opposite sides, i.e., surfaces, thereof. In this manner, the shoes 12 may be confined by the cooperation of the clips 20*a* and 20*b*, flange 22 and stationary shoe-retaining plate 26.

By so positioning the shoes 12, they are readily visually apparent when the shoe transporting device is being carried. Thus, the manufacturer has a consumer-carried advertisement following purchase of the shoes as they are being transported to the consumer's home. If desired, the stationary shoe-retaining plate 26 can also carry the logo of the manufacturer and/or shoe store.

In addition, a circular metal rack can be used in cooperation with the shoe transporting device 10. For instance, a multi-tiered rack having a plurality of radially projecting and circumferentially spaced pairs of fingers can be used to display shoes in the transporting devices 10 wherein adjacent fingers of a pair extend on opposite sides of the second portion 16b of the vertical divider 16 under the shoe carrying handle 18. As will be appreciated, this makes an attractive and effective display.

In order to maximize the desirability of the invention, it may be molded of a clear plastic material. This not only renders the shoes 12 and/or logo on the stationary shoe-retaining plate 26 dominant, but also renders the shoe transporting device 10 relatively inexpensive. Nevertheless, it will be of a strength and durability to permit the consumer to reuse the device.

In this connection, the consumer may well want to utilize the shoe transporting device 10 to carry athletic shoes on a regular basis. Thus, the shoes can be transported to and from athletic events where they are not only visible providing additional exposure for the shoe manufacturer but also are able to air out between athletic performances. As should now be appreciated, the shoe transporting device 10 has a multitude of significant advantages.

While in the foregoing there has been set forth a preferred embodiment of the invention, it will be appreciated that the details herein given may be varied by those skilled in the art without departing from the true spirit and scope of the appended claims.

I claim:

1. A device for transporting a pair of shoes, comprising:

a base adapted to receive the heels of said pair of shoes and to support said pair of shoes in a generally vertical orientation, and including means associated with said base for releasably receiving the heels of said pair of shoes in oppositely facing direction on opposite sides of said base, said heel receiving means including a flange conforming to the heels of said pair of shoes and extending substantially entirely about the periphery of said base;

a vertical divider extending upwardly of said base and terminating in a shoe carrying handle at a point remote from said base, said vertical divider including a first portion integral with said base and a second portion pivotally mounted to said first portion remote from said base;

said base being generally oval-shaped and said vertical divider being generally planar to divide said base into opposed heel-receiving portions on opposite sides thereof, said vertical divider being such that said second portion is pivotable into and out of coaxial relation with said first portion for retaining and releasing shoes therefrom;

means associated with said vertical divider for releasably retaining said pair of shoes in said generally vertical orientation, said shoe retaining means including a pair of resilient clips disposed on said second portion of said vertical divider intermediate said base and said shoe carrying handle, said resilient clips being disposed in a position to grip the toes of said pair of shoes when said first and second portions are coaxial; and means associated with said vertical divider for adjusting the location where said second portion is pivotally mounted to said first portion to adjust the height of said vertical divider to accommodate different sized shoes.

2. The shoe transporting device of claim 1 wherein said second portion of said vertical divider has an extension for supporting said resilient clips intermediate opposite ends thereof.

3. The shoe transporting device of claim 1 wherein said shoe carrying handle is disposed on the end of said second portion of said vertical divider remote from said base.

4. The shoe transporting device of claim 1 including a stationary shoe-retaining plate on an extension of said first portion of said vertical divider remote from said base.

5. The shoe transporting device of claim 4 wherein said stationary shoe-retaining plate is positioned for engagement by the soles of said pair of shoes when the toes are gripped by said resilient clips.

6. A device for transporting a pair of shoes, comprising:

a base adapted to receive the heels of said pair of shoes and to support said pair of shoes in a generally vertical orientation, and including means associated with said base for releasably receiving the heels of said pair of shoes in oppositely facing direction on opposite sides of said base, said heel receiving means including a flange conforming to the heels of said pair of shoes and extending substantially entirely about the periphery of said base;

a vertical divider extending upwardly of said base and terminating in a shoe carrying handle at a point remote from said base, said vertical divider including a first portion integral with said base and a second portion pivotally mounted to said first portion remote from said base, said shoe carrying handle being disposed on the end of said second portion of said vertical divider remote from said base;

said vertical divider being generally planar to divide said base into opposed heel-receiving portions on opposite sides thereof and being such that said second portion is pivotable into and out of coaxial relation with said first portion for retaining and releasing shoes therefrom;

means associated with said vertical divider for releasably retaining said pair of shoes in said generally vertical orientation, said shoe retaining means including a pair of resilient clips disposed on said second portion of said vertical divider intermediate said base and said shoe carrying handle, said resilient clips being disposed in a position to grip the toes of said pair of shoes when said first second portions coaxial;

said second portion of said vertical divider having an extension for supporting said resilient clips intermediate opposite ends thereof, and including a stationary shoe-retaining plate on an extension of said first portion of said vertical divider remote from said base, said stationary shoe-retaining plate being positioned for engagement by the soles of said pair of shoes when the toes are gripped by said resilient clips; and means associated with said vertical divider for adjusting the location where said second portion is pivotally mounted to said first portion to adjust the height of

7. The shoe transporting device of claim 6 wherein said base is generally oval-shaped to receive the heels of said pair of shoes with the soles in generally confronting relation in engagement with said vertical divider on opposite sides thereof.

8. The shoe transporting device of claim 6 wherein said pivotal mounting adjustment means includes an opening in said second portion of said vertical divider adapted for alignment with and securement by means of a releasable fastener to any of a plurality of vertically spaced openings in said first portion of said vertical divider.

9. The shoe transporting device of claim 6 including a stop associated with said vertical divider for allowing pivotal movement of said second portion of said vertical divider in one direction to move said first and second portions out of coaxial relation to release said pair of shoes and for restricting pivotal movement of said second portion of said vertical divider in the opposite direction to move said first and second portions into coaxial relation to retain said pair of shoes.

* * * * *